US008544977B2

(12) United States Patent
Kodoi

(10) Patent No.: US 8,544,977 B2
(45) Date of Patent: Oct. 1, 2013

(54) LIQUID DISCHARGE HEAD

(75) Inventor: Takuma Kodoi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 331 days.

(21) Appl. No.: 13/022,135

(22) Filed: Feb. 7, 2011

(65) Prior Publication Data

US 2011/0234703 A1 Sep. 29, 2011

(30) Foreign Application Priority Data

Mar. 24, 2010 (JP) ..... 2010-068191

(51) Int. Cl.
*B41J 29/377* (2006.01)
*B41J 2/05* (2006.01)

(52) U.S. Cl.
USPC ..... 347/18; 347/61

(58) Field of Classification Search
None
See application file for complete search history.

(56) References Cited

U.S. PATENT DOCUMENTS 6,137,502 A * 10/2000 Anderson et al. ..... 347/15
6,454,397 B1 * 9/2002 Hirata ..... 347/64
7,434,917 B2 * 10/2008 Iijima ..... 347/62

FOREIGN PATENT DOCUMENTS

JP 08-156258 A 6/1996
JP 2005-280068 A 10/2005

* cited by examiner

*Primary Examiner* — Geoffrey Mruk
(74) *Attorney, Agent, or Firm* — Fitzpatrick, Cella, Harper & Scinto

(57) ABSTRACT

A liquid discharge head includes a substrate including a plurality of nozzle arrays formed by arranging nozzles having heat generating elements generating thermal energy for discharging a liquid, and a plurality of common liquid chambers formed along the plurality of nozzle arrays to supply the liquid to the plurality of nozzle arrays, the substrate being divided into a plurality of substrate portions by the plurality of common liquid chambers. The substrate includes a first substrate portion having a first nozzle array among the plurality of nozzle arrays and a second substrate portion having a second nozzle array different from the first nozzle array and a thermal capacity larger than that of the first substrate portion. A heating area of each first heat generating element provided in the first nozzle array is smaller than that of each second heat generating element provided in the second nozzle array.

13 Claims, 16 Drawing Sheets

LIQUID DISCHARGE HEAD

BACKGROUND OF THE INVENTION

1. Field of the Invention

The present invention relates to a liquid discharge head that includes a heat generating element generating thermal energy for discharging a liquid.

2. Description of the Related Art

A recording apparatus such as a printer, a copying machine, and a facsimile records an image formed from a dot pattern on a recording material such as a thin paper or a plastic sheet on the basis of image information. The dot pattern is formed by, for example, a liquid such as ink. The recording apparatus may be largely classified into an ink jet type, a wire dot type, a thermal type, a laser beam type, and the like in accordance with a recording type. Among these types, the ink jet type recording apparatus performs a recording operation by discharging liquid droplets from a discharge port of a liquid discharge head so as to be adhered to a recording material.

In recent years, a number of recording apparatuses have been used, and in these recording apparatuses, there have been an increasing demand in which the recording operation needs to be silently performed at a high speed with high resolution and high image quality. As one of the recording apparatuses satisfying the demand, the ink jet type recording apparatus may be exemplified. In the ink jet type recording apparatus, a recording operation is performed by discharging a liquid from a liquid discharge head. For this reason, in order to satisfy the aforementioned demand, the liquid needs to be stably discharged while ensuring a stable discharge amount of the liquid. Stability in liquid discharge is largely influenced by the temperature of the liquid discharge head.

Particularly, in the recording apparatus configured to form a bubble in solid ink or liquid ink by using thermal energy and to discharge the ink as an ink droplet, the discharge characteristics greatly change due to the temperature of the liquid discharge head. Further, since there is a restriction in the time (refill frequency) until a liquid chamber (bubbling chamber) provided in the liquid discharge head is filled with a liquid after the liquid is discharged to the outside, increases in recording speed are restricted. However, in recent years, a liquid discharge head capable of performing a rapid printing operation has been developed, whereby the printing operation may be performed much faster than that of the related art.

However, when the recording operation is rapidly performed, the amount of accumulated heat increases, so that the liquid may not be stably discharged to the outside. Particularly, a problem arises in that the amount of liquid to be discharged becomes irregular due to a rising temperature. In order to solve the irregular discharge amount of the liquid, Japanese Patent Application Laid-Open No. 2005-280068 discloses a structure in which the temperature of a head is detected, and the discharge ratio between a large dot (liquid droplet) and a small dot (liquid droplet) changes on the basis of the detection result. Further, Japanese Patent Application Laid-Open No. H08-156258 discloses a structure in which the number of liquid droplets to be discharged is counted, and the application time of a voltage applied to an electric thermal conversion element as a heat generating element is controlled on the basis of the counted number.

In the recording heads disclosed in Japanese Patent Application Laid-Open No. 2005-280068 and Japanese Patent Application Laid-Open No. H08-156258, when there is a difference in temperature distribution for every discharge port array, a problem arises in that a temperature control method needs to be changed for each discharge port array so that the liquid discharge performance for each discharge port array attains a predetermined liquid discharge performance.

Particularly, in recent years, the recording operation has been conducted at the high speed with the high duty, the low pass, and the elongated nozzle. For this reason, a temperature of a substrate (head substrate) constituting a liquid discharge head may partly increase due to the recording operation. As a result, even in the recording operation by one scanning operation, a difference in discharge amounts occurs for each discharge port array, so that the concentration of a recorded image becomes remarkably irregular.

Further, the number of interconnections decreases and the size of a circuit decreases in accordance with the advanced technology, which realizes a decrease in the size of a substrate and enables a design in which more substrates may be manufactured from one silicon wafer. As a result, as shown in FIG. 24, a volume of a substrate portion 802 in the periphery of each heat generating element 801 provided in a discharge port array 800 (nozzle array) may be different. Specifically, a head substrate 803 is divided into plural substrate portions 802 by common liquid chambers 804 supplying a liquid to a nozzle and extending in a shape of plural lines, and the volume of each substrate portion 802 provided with each discharge port array 800 is different.

In the substrate portion 802 (a portion located at the end portion of the substrate in FIG. 24) having a small volume, a thermal diffusion portion radiating heat to the nozzle array is small. For this reason, a problem arises in that a temperature remarkably increases in the vicinity of the discharge port array 800 formed in the substrate portion 802 having a small volume rather than the vicinity of the discharge port array 800 formed in the substrate portion 802 having a large volume. Particularly, the substrate portion 802 located at the end portion of the substrate contacts a sealing material or atmosphere, and the sealing material or the atmosphere has thermal conductivity and specific heat smaller than that of the liquid inside the common liquid chamber. Accordingly, the heat radiation performance of the substrate portion 802 located at the end portion of the substrate becomes smaller than that of the substrate portion 802 interposed between the common liquid chambers 804.

In a system in which a variation in thermodynamic state may be disregarded at the time of the input or output of thermal energy, thermal capacity is dependent on the amount of material and the specific heat or thermal conductivity thereof. Further, the interval between the adjacent heat generating elements is becoming narrower due to increasing density such as in a nozzle of 1200 dpi and the like. For this reason, when the heat generating element continuously radiates heat, rising temperature during one scanning becomes more apparent.

As described above, due to differences in thermal capacity, thermal conductivity, specific heat, and the like around each heat generating element, a large difference in temperature distribution of the substrate portion around each nozzle array occurs. When the temperature distribution is largely different for each nozzle array, it is necessary to perform particular control in accordance with the temperature distribution for each nozzle array in order to realize a recording operation without irregularity. Further, when each nozzle array needs to be controlled, it is necessary to further install a temperature sensor in order to improve the measurement precision of the temperature distribution. Further, when the temperature is controlled for each nozzle array, there are problems in that the control system becomes complex and the number of interconnections increases. Further, there are problems in that a difference in temperature distribution occurs even in a recording operation of a single scan and irregularity in recording operation occurs.

SUMMARY OF THE INVENTION

A liquid discharge head includes: a substrate including a plurality of nozzle arrays which is formed by arranging nozzles having heat generating elements generating thermal energy for discharging a liquid, and a plurality of common liquid chambers which is formed along the plurality of nozzle arrays and supplies the liquid to the plurality of nozzle arrays, the substrate being divided into a plurality of substrate portions by the plurality of common liquid chambers, wherein the substrate includes a first substrate portion having a first nozzle array among the plurality of nozzle arrays and a second substrate portion having a second nozzle array different from the first nozzle array and a thermal capacity larger than that of the first substrate portion, and wherein a heating area of the first heat generating element provided in the first nozzle array is smaller than that of the second heat generating element provided in the second nozzle array.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, exemplary embodiments of the invention will be described in detail by referring to the accompanying drawings. However, the components described in the embodiments below are merely examples, and the scope of the invention is not limited to the embodiments.

Further, in the specification, the recording operation indicates not only a case of forming meaningful information such as characters, figures, and pictures, but also a case of forming images on a medium in a broad sense regardless of whether the information is visibly recorded.

Figure 1A:
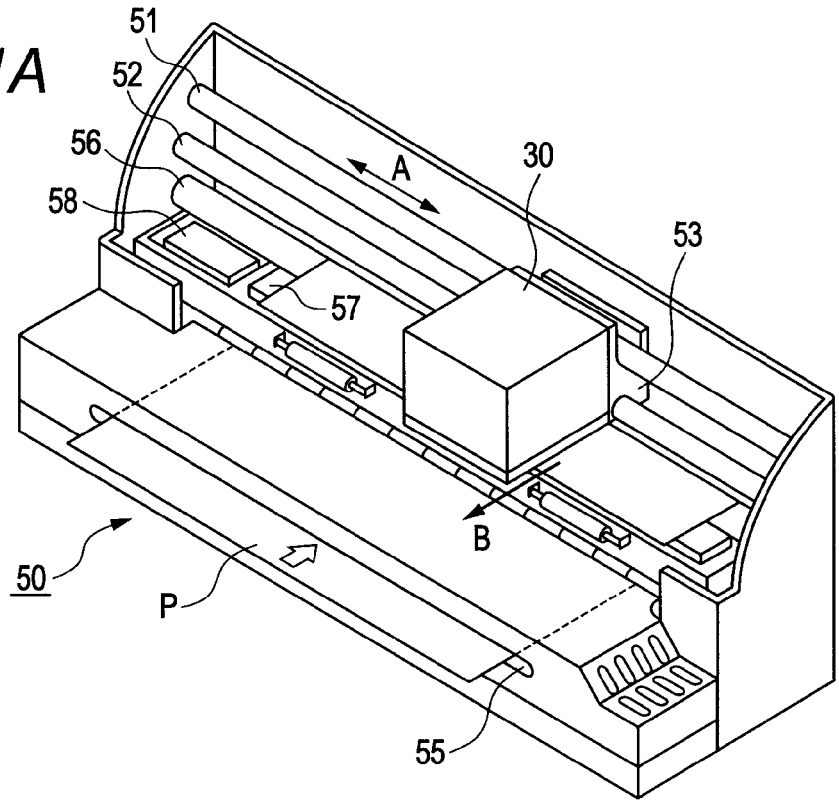
FIGS. 1A and 1B are schematic perspective views illustrating a recording apparatus and a liquid discharge head of a first embodiment of the invention.
Figure 1B:
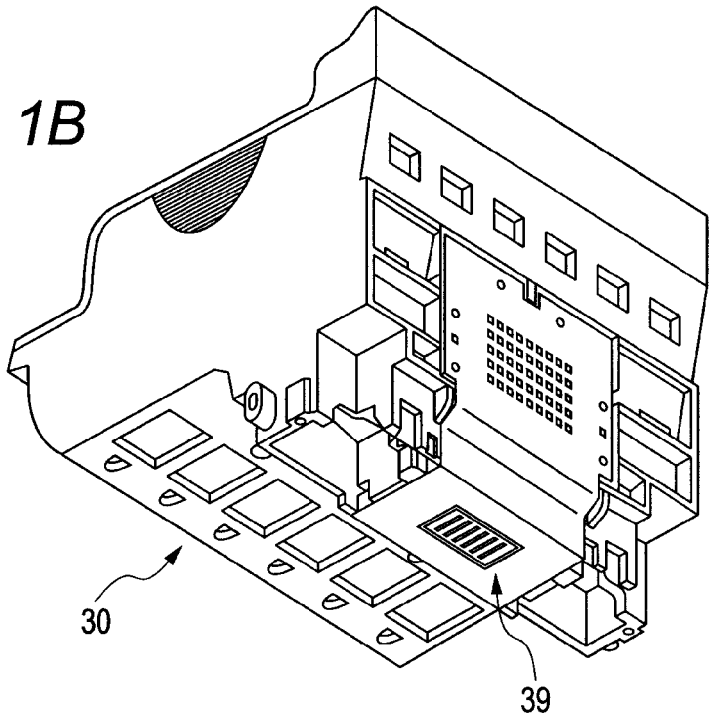

FIG. 1A is a schematic perspective view illustrating a recording apparatus of a first embodiment. FIG. 1B is a schematic perspective view illustrating a liquid discharge head provided in the recording apparatus of FIG. 1A. A recording apparatus 50 of the embodiment is a serial scan type ink jet recording apparatus, but the type of the recording apparatus of the embodiment is not limited thereto. That is, the invention may be applied to a general recording apparatus that performs a recording operation by discharging a liquid using energy generated from a heat generating element.

The recording apparatus 50 includes a carriage 53, and the carriage 53 is movably guided by guide shafts 51 and 52 in the primary scanning direction (indicated by the arrow A in FIG. 1A). The carriage 53 moves forward or backward in the primary scanning direction A using a carriage motor (not shown) and a driving force transfer mechanism (not shown) such as a belt transferring a driving force of the carriage motor. The carriage 53 is mounted with a liquid discharge head 30 and an ink tank (not shown) supplying, for example, a liquid such as ink to the liquid discharge head 30. The liquid discharge head 30 and the ink tank may be formed as separate components or may be integrated with each other to constitute a cartridge. A sheet P as a recording material is inserted from an insertion port 55 provided at one end side of the recording apparatus 50, and is transported in the secondary scanning direction (indicated by the arrow B in FIG. 1A) by a transfer roller 56 while its transportation direction is reversed. The recording apparatus 50 repeats a recording operation in which a liquid is discharged toward a printing area of the sheet P on a platen 57 while the carriage 53 mounted with the liquid discharge head 30 is moved in the primary scanning direction A and a transportation operation in which the sheet P is transported in the secondary scanning direction B by a distance corresponding to the recording width. By repeating the recording operation and the transportation operation, an image is sequentially recorded on the sheet P.

A recovery system unit 58 serving as a recovery unit is provided at one end side of the movement area of the carriage 53 so as to face a surface 39 (hereinafter, referred to as a discharge port formation surface) having discharge ports of the liquid discharge head 30 mounted on the carriage 53. The recovery system unit 58 includes a cap (not shown) which caps the discharge ports of the liquid discharge head 30, a suction pump (not show) which depressurizes a space between the cap and the discharge port formation surface 39 of the liquid discharge head 30, and the like. When a liquid is discharged after the inner space of the cap capping the discharge ports is depressurized to suction the liquid from the inside of the discharge ports, the liquid discharge performance of the liquid discharge head 30 may be satisfactorily maintained. Further, when the liquid is discharged from the discharge ports toward the cap capping the discharge port formation surface 39, discharge failure or the like of the liquid discharge head 30 may be recovered.

Figure 2A:
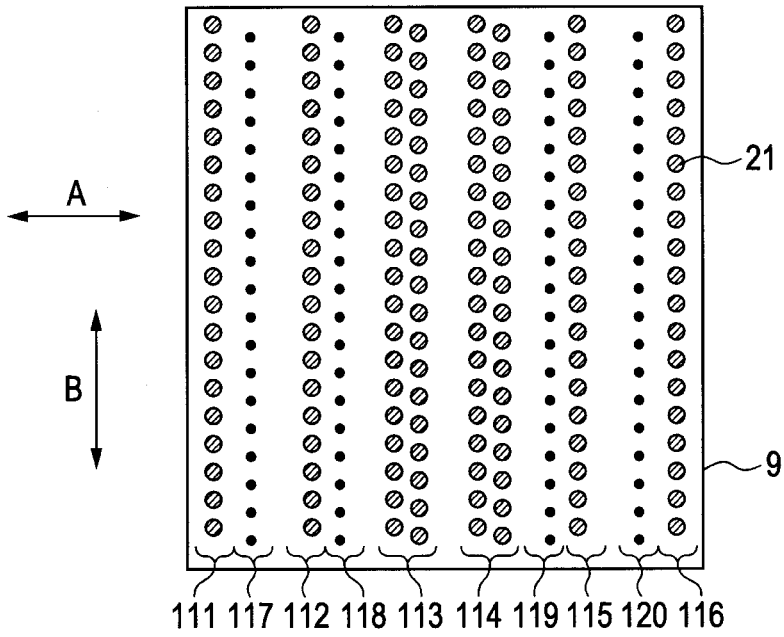
FIG. 2A is a schematic plan view illustrating a discharge port formation surface of the liquid discharge head.

FIG. 2A is a schematic plan view illustrating an example of the discharge port formation surface 39 of the liquid discharge head 30. The liquid discharge head 30 includes a substrate 9 with plural nozzles. Each nozzle includes a discharge port 21 discharging a liquid therefrom. In the embodiment, the discharge ports having two types of sizes are provided in order to discharge different sizes of liquid droplets and record different sizes of dots on a recording material (sheet). In FIG. 2A, the reference numerals 117 to 120 indicate the discharge port arrays discharging liquid droplets for a small dot, and the reference numerals 111 to 116 indicate the discharge port arrays discharging liquid droplets for a large dot. In the embodiment, the discharge port array discharging a large liquid droplet includes the discharge port arrays 111 and 116 for cyan (C), the discharge port arrays 112 and 115 for magenta (M), the discharge port array 113 for yellow (Y), and the discharge port arrays 114 for black (K). Further, the discharge port array discharging a small liquid droplet includes the discharge port arrays 117 and 120 for cyan (C) and the discharge port arrays 118 and 119 for magenta (M). As shown in FIG. 2A, the discharge port arrays 111, 112, 115, and 116 for cyan and magenta are disposed to be symmetrical to each other with respect to the direction (the secondary scanning direction) B perpendicular to the primary scanning direction A. This arrangement is designed to prevent irregularity in recording operation if the order of discharging the liquid changes when the carriage 53 moves in both directions, that is, a forward movement direction and a backward movement direction.

Figure 2B:
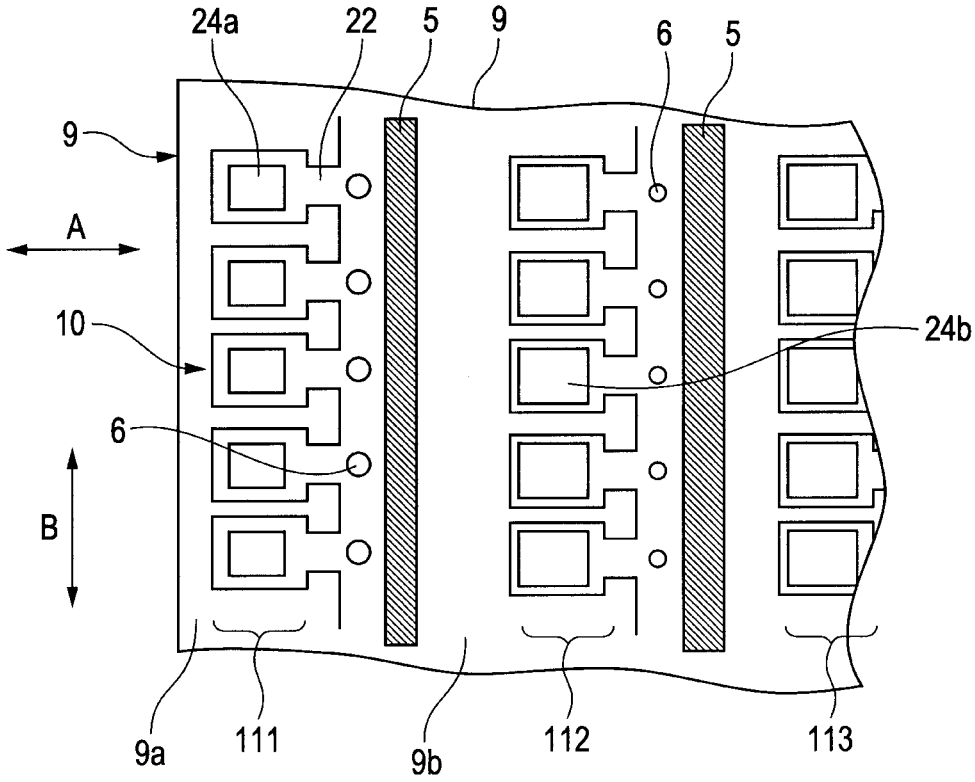
FIG. 2B is a schematic cross-sectional view in a plane parallel to the discharge port formation surface.
Figure 3:
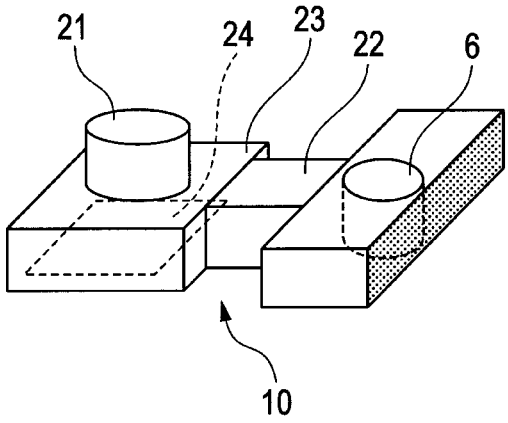
FIG. 3 is a schematic view illustrating a shape of a passage for a liquid formed in the liquid discharge head.

FIG. 2B is a schematic cross-sectional view of the liquid discharge head in the plane parallel to the discharge port formation surface 39, and shows an example in which the discharge ports are formed in an arrangement different from that of the example shown in FIG. 2A. FIG. 3 is schematically illustrates a shape of a typical one nozzle 10 formed in the liquid discharge head 30. The liquid discharge head 30 includes a substrate 9 provided with nozzle arrays 111, 112, and 113 which are formed by the arranged nozzles 10 and plural common liquid chambers 5 which are formed along the nozzle array 111, 112, and 113 and supply a liquid to the nozzle arrays 111, 112, and 113. Each nozzle 10 includes a passage 22, a bubbling chamber 23, a discharge port 21, and a heat generating element 24. A liquid is supplied from a liquid supply port (not shown) communicating with the ink tank into the passage 22 communicating with the bubbling chamber 23 constituting each nozzle 10 via the common liquid chamber 5. The liquid supplied to the passage 22 is held by the bubbling chamber 23, and forms a meniscus at the discharge port 21. Further, a columnar nozzle filter 6 is integrally formed with the substrate 9 between the common liquid chamber 5 and the bubbling chamber 23. The nozzle filter 6 is a protrusion portion or a columnar portion which is provided between the common liquid chamber 5 and the bubbling chamber 23 in order to prevent waste or the like mixed in the liquid discharge head 30 from intruding into the bubbling chamber 23. The nozzle filter 6 serves as a factor of determining a rear resistance (which will be described later) of the nozzle 10. For example, the heat generating element 24 such as an electric thermal conversion element is provided inside the bubbling chamber 23 constituting each nozzle 10. Due to thermal energy generated from the heat generating element 24, the liquid inside the bubbling chamber 23 is heated so that film boiling occurs. Through the bubbling energy generated at this time, a liquid droplet is discharged from each discharge port 21. Hereinafter, the amount of the liquid discharged from each discharge port 21 will be referred to as the discharge amount.

The liquid discharge head 30 has a nozzle array in which plural nozzle arrays, each having the nozzles 10 arranged in the secondary scanning direction B, are arranged in the primary scanning direction A. Each nozzle 10 includes discharge ports 21. The liquid present inside the common liquid chamber 5 is supplied to the bubbling chamber 23 via the passage 22 of each nozzle 10. In the example shown in FIG. 2A, the common liquid chamber 5 is present between the large discharge port array 111 and the small discharge port array 117 for cyan and between the large discharge port array 112 and the small discharge port array 118 for magenta. That is, the common liquid chamber is present between the discharge port arrays (nozzle arrays) discharging the same kind of liquid. The same liquid is discharged from plural discharge ports 21 communicating one common liquid chamber 5.

Since the liquid is supplied into each common liquid chamber 5, each nozzle array may discharge the liquid. Specifically, each nozzle constituting the first nozzle array communicates with the first common liquid chamber among the plural common liquid chamber 5, and each nozzle constituting the second nozzle array communicates with the second common liquid chamber different from the first common liquid chamber. Then, the first liquid supplied into the first common liquid chamber may be different from the second liquid supplied into the second common liquid chamber.

The substrate 9 is divided into plural substrate portions by the plural common liquid chambers 5. That is, the common liquid chamber 5 is provided to suppress heat transfer from the substrate portion provided with the large discharge port array 111 for cyan to the substrate portion provided with the small discharge port array 117 for cyan. In this manner, the discharge port arrays (nozzle arrays) are present at both sides of the common liquid chamber 5, heat transfer from one nozzle array to the other nozzle array is suppressed.

FIG. 2B illustrates an example in which each of the discharge port arrays 111, 112, and 113, that is, the nozzle arrays is present only at one side of the common liquid chamber 5. Specifically, the nozzle array communicating with one common liquid chamber 5 is disposed only at one side of the common liquid chamber 5. In FIG. 2B, a first substrate portion 9*a* which is not interposed between two common liquid chambers 5 and is located at the edge portion 11 of the substrate is formed to have a volume smaller than that of a second substrate portion 9*b* which is interposed between the common liquid chambers 5. Accordingly, the thermal capacity the first substrate portion 9*a* located at the edge portion 11 of the substrate is smaller than that of the second substrate portion 9*b* interposed between the common liquid chambers 5. Further, since the edge portion 11 of the substrate contacts a sealing material and/or atmosphere having thermal conductivity and specific heat smaller than that of the substrate 9, the thermal capacity or thermal diffusion of the first substrate portion 9*a* is smaller than that of the second substrate portion 9*b*. For this reason, in the first substrate portion 9*a* having a small thermal capacity and thermal diffusion, a quantity of heat generated by the discharge operation needs to be suppressed more than that of the second substrate portion 9*b*.

Here, the amount of liquid discharged from the nozzle (the nozzle constituting the nozzle array 111 in the example shown in FIG. 2B) formed in the first substrate portion 9*a* is defined as a discharge amount Va. Then, the amount of liquid discharged from the nozzle (the nozzle constituting the nozzle array 112 shown in FIG. 2B) formed in the second substrate portion 9*b* is defined as a discharge amount Vb. Further, the size (heating area) of a first heat generating element 24*a* formed in the first substrate portion 9*a* is defined as Sa, and the size (heating area) of a second heat generating element 24*b* formed in the second substrate portion 9*b* is defined as Sb. In the embodiment, the size (heating area) Sa of the first heat generating element 24*a* constituting the nozzle array 111 formed in the first substrate portion 9*a* is smaller than the size (heating area) Sb of the second heat generating element 24*b* constituting the nozzle array 112 formed in the second substrate portion 9*b*. At this time, it is desirable that the discharge amount Va is substantially equal to the discharge amount Vb. That is, the discharge amount per unit area of the first heat generating element 24*a* is larger than that of the second heat generating element 24. As described above, the temperature of the nozzle array provided in the substrate portion 9*a* having a small thermal capacity easily increases. For this reason, the heat quantity of the first substrate portion 9*a* located at the edge portion 11 of the substrate is suppressed by a highly efficient nozzle design of the nozzle array 111 provided in the first substrate portion 9*a* located at the edge portion 11 of the substrate so that a liquid droplet may fly using less energy.

Figure 4A:
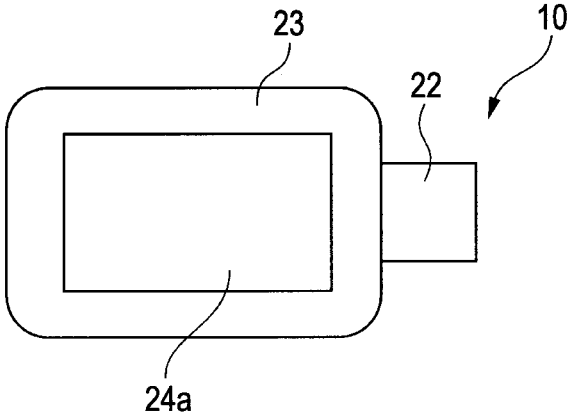
FIGS. 4A and 4B are schematic views illustrating the nozzle constituting the nozzle array provided at the farthest end of the substrate portion and the nozzle array provided at the inner side of the substrate portion according to the first embodiment of the invention.
Figure 4B:
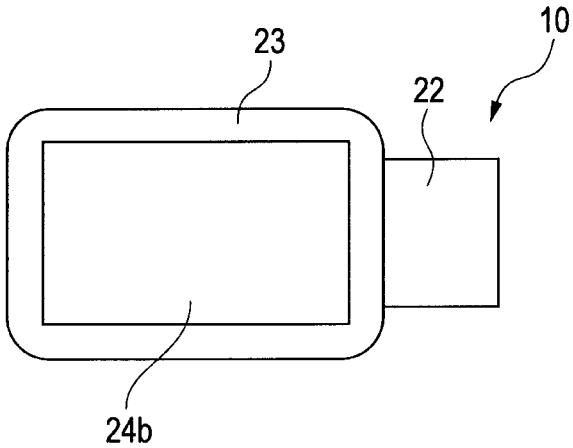

FIG. 4A schematically illustrates the nozzle constituting the nozzle array 111 provided in the first substrate portion 9*a*. FIG. 4B schematically illustrates the nozzle constituting the nozzle array 112 provided in the second substrate portion 9*b*. Here, the nozzle constituting the outermost nozzle array and the nozzles constituting the inner nozzle arrays 112 to 115 have the substantially same discharge amount, and as shown in FIGS. 4A and 4B, the first heat generating element 24*a* is set to be smaller than the second heat generating element 24*b*. In this manner, since the small heat generating element 24*a* is disposed in the substrate portion 9*a* having a small thermal capacity, a difference in temperature of the substrate portion may be suppressed when a liquid is discharged.

Here, the discharge amounts Va and Vb are set to be equal to each other. However, in the embodiment, it is assumed that a difference between discharge amounts Va and Vb is equal to or more than 0.7 times the discharge amount Va and equal to or less than 1.3 times the discharge amount Va in consideration of a difference in discharge amount or a difference in liquid amount. The difference in discharge amount is reflected in consideration of a difference in discharge amount due to characteristics such as viscosity of the liquid or a difference in the size of the discharge port 21 due to a width tolerance in design. When the difference between the discharge amounts Va and Vb is within the above-described range, a difference in discharge amount of the liquid from each nozzle array is small, and irregularity of the recording operation is reduced within the range where the irregularity may be substantially permitted.

Figure 5A:
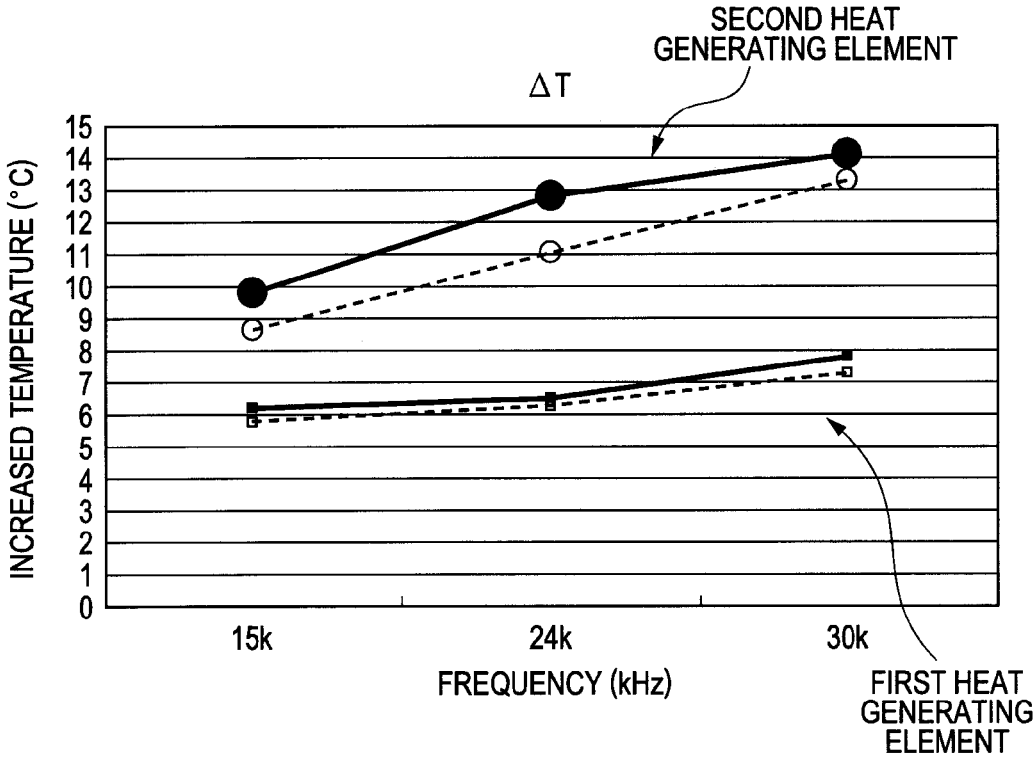
FIG. 5A is a graph illustrating a difference in rising temperature due to a difference in size of a heat generating element.

Here, a result of a test conducted to see how much a temperature changes due to a difference in size between the first heat generating element 24*a* and the second heat generating element 24*b* will be described. FIG. 5A illustrates a result of a test in which the first heat generating element 24*a* having a heating area 1.3 times that of the second heat generating element 24*b* is used and two nozzle arrays having 256 nozzles arranged at the pitch of 1200 dpi discharge a liquid 4800 times by three types of driving frequencies. Here, "dpi" indicates the number of the discharge ports (the number of the nozzles) formed within 1 inch (about 2.54 cm) of width. Further, a voltage was applied 4800 times by using the electric thermal conversion element as the heat generating element so as to perform the discharge operation. In the result depicted by the dashed line of FIG. 5A, the application time of the voltage for each discharge operation is set to be shorter than that of the result depicted by the solid line. As understood from the test result, the temperature increases enormously when the size of the heat generating element is large (in the case of the second heat generating element). Although it is quite natural, since thermal energy generated by the heat generating element increases when the application time of the voltage is long, the temperature largely increases.

Figure 5B:
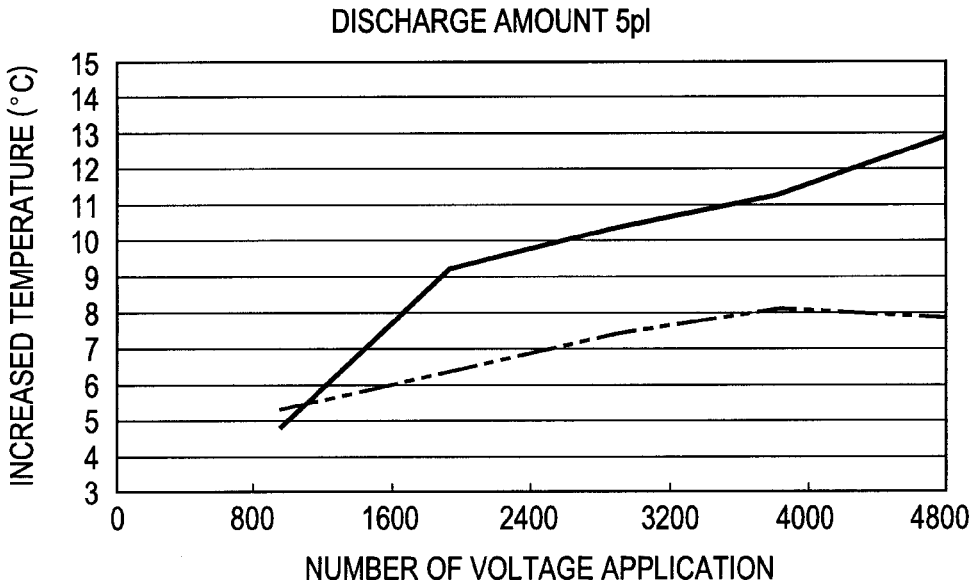
FIG. 5B is a graph illustrating a difference in rising temperature due to a difference in distance between the heat generating elements.

Further, a test was conducted to see how much the temperature changes due to a difference in the distance between the heat generating elements. FIG. 5B illustrates an increase in temperature when a liquid is discharged 4800 times from each nozzle having a heat generating element with the same size. In the test, the results obtained when discharging a liquid from the nozzle array having 256 nozzles arranged with about 42.5 μm of center-to-center distance were compared with each other. The solid line of FIG. 5B indicates a result when a liquid is discharged from all of 256 nozzles, and the dashed line indicates a result when a liquid is discharged from alternate nozzles among 256 nozzles. As understood from the drawing, an increase in temperature is suppressed when a distance between the adjacent heat generating elements 24 becomes longer. This is because the volume of the substrate portion with respect to one heat generating element to which a voltage is applied becomes larger and the area where a heat is diffused becomes wider. Further, when the heat generating element becomes smaller, the heat quantity becomes smaller, and the distance between the heat generating elements becomes larger. For this reason, in this case, an increase in temperature may be more effectively suppressed. In the specification, the meaning that the distance between the heat generating elements becomes larger indicates that the first heat generating element 24*a* constituting the nozzle array located at the edge portion 11 of the substrate becomes smaller in the width direction than the second heat generating element 24*b* constituting the nozzle array located at the inner position.

Accordingly, when the nozzles are formed to have the same discharge amount in the example shown in FIG. 2B, the heat quantity of the first substrate portion 9*a* may be suppressed by making the size Sa of the first heat generating element 24*a* smaller than the size Sb of the second heat generating element 24*b*.

Figure 6:
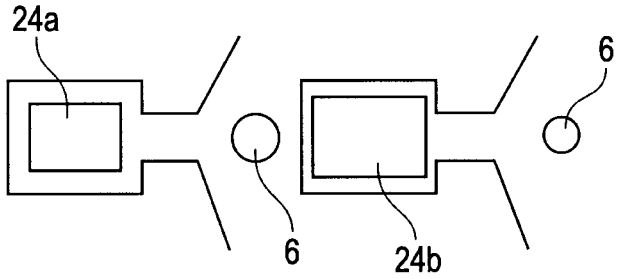
FIG. 6 is a schematic view illustrating an example in which a rear resistance of the nozzle is changed for each nozzle array.

In this manner, when the heating area of the first heat generating element is made smaller, a problem may arise in that the liquid discharge characteristic of the first heat generating element 24*a* is not equal to the liquid discharge characteristic of the second heat generating element 24*b*. As an example of solving this problem, it is desirable that the volume of the nozzle filter 6 provided in the nozzle array 111 located at the first substrate portion 9*a* is made larger than the nozzle filter 6 provided in the nozzle array located at the second substrate portion 9*b* (refer to FIG. 6). In FIG. 6, the volume of the nozzle filter 6 with respect to the nozzle having the first heat generating element 24*a* becomes larger than the volume of the nozzle filter 6 with respect to the nozzle having the second heat generating element 24*b*. Accordingly, a first rear resistance Ra of the nozzle constituting the first nozzle array provided in the first substrate portion 9*a* becomes larger than a second rear resistance Rb of the nozzle constituting the second nozzle array provided in the second substrate portion 9*b*. In the specification, the "rear resistance" is defined by the sum of flow resistance and viscous resistance from the common liquid chamber of the nozzle to the boundary between the passage and the bubbling chamber. In the example shown in FIG. 6, since the volume of the nozzle filter 6 provided in the first substrate portion 9*a* is large, the bubbling energy is more easily transferred toward the discharge port 21 in the nozzle. When the rear resistance of the nozzle becomes larger, energy (energy released to the rear side) not used for the operation of discharging the liquid during a bubbling operation becomes smaller, whereby the liquid may be more effectively discharged. Accordingly, when the first rear resistance Ra of the nozzle having the first heat generating element 24*a* is set to be larger than the second rear resistance Rb of the nozzle having the second heat generating element 24*b*, the liquid discharge performance from both nozzles may be equalized.

Further, in the specification, the "front resistance" is defined by the sum of flow resistance and viscous resistance from the bubbling chamber 23 to the opening side end portion of the discharge port 21. Then, when a first front resistance of the nozzle provided in the first substrate portion 9*a* is denoted by Rfa, a rear resistance is denoted by Ra, a second front resistance of the nozzle provided in the second substrate portion 9*b* is denoted by Rfb, and a rear resistance is denoted by Rb, it is desirable that any one of the relationships of the equations (1) to (3) is satisfied.

$$Rfa=Rfb \text{ and } Ra>Rb \quad (1)$$

$$Ra=Rb \text{ and } Rfa<Rfb \quad (2)$$

$$Rfa\neq Rfb,\ Ra\neq Rb, \text{ and } Rfa/Ra<Rfb/Rb. \quad (3)$$

Further, when the relationship of the equation is satisfied, the filling of the liquid from the rear side (upstream) of the nozzle to the bubbling chamber 23 may be delayed. In order to solve this problem, it is desirable that a liquid having a high capillary force is supplied to the nozzle of the first substrate portion 9*a*, or a liquid having a high surface tension or low viscosity is supplied to the nozzle of the first substrate portion 9*a*.

In the above-described example, a structure is disclosed in which the size of the nozzle filter is different to appropriately change the front resistance and the rear resistance of the nozzle. However, the invention is not limited thereto, but as described in the embodiment below, various structures may be used in which the arbitrary component of the nozzle has characteristics.

When an organic solvent is used as the liquid, in most cases, the surface tension decreases as the viscosity decreases. However, in the nozzle having a high driving frequency, the viscosity rather than the surface tension may be used as an important index for determining the discharge performance. This is for the following reasons. In a discharge state (BTJ discharge) communicating with the atmosphere, the filling of the liquid is largely dependent on the magnitude of the capillary force or the surface tension, and the driving frequency may not be made become larger as much as the magnitude. For this reason, in order to discharge the liquid at the high driving frequency, the discharge state (BJ discharge) where the inside of the nozzle does not communicate with the atmosphere is used. In the BJ discharge, the liquid may be discharged at the high driving frequency by ensuring a high height from the heat generating element to the opening side of the discharge port, and the nozzle is immediately filled with the liquid by depressurization of the bubble(s). Accordingly, from the viewpoint of the flowing of the liquid, the easy movement of the liquid, that is, the easy flowing degree (viscosity) of the liquid is more importantly considered rather than the action of the capillary force with respect to the liquid.

Figure 7A:
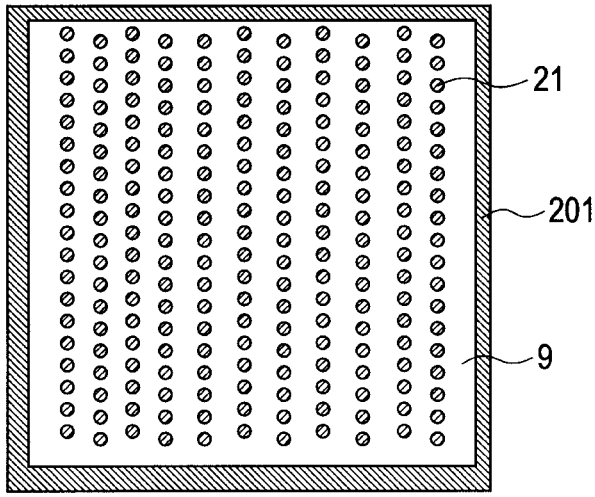
FIGS. 7A and 7B are schematic views illustrating an example of the substrate of the liquid discharge head having the substrate heating heater.
Figure 7B:
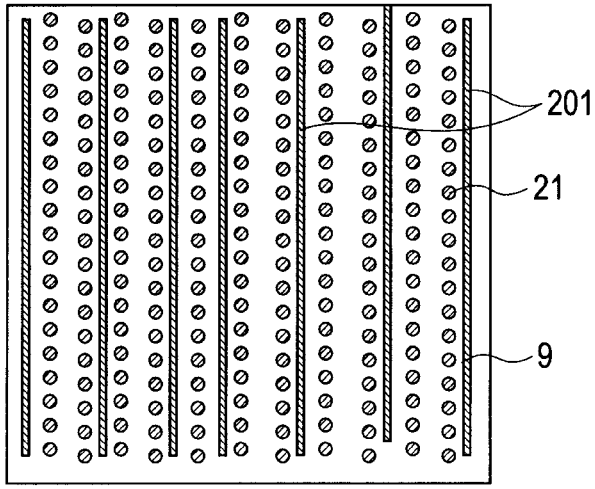

Further, when the liquid having a high viscosity is used in the nozzle having the small first heat generating element 24*a*, the discharge operation may not be stably performed at the first discharge operation. This may be solved by warming the liquid or the first substrate portion 9*a* before discharging the liquid. Regarding the temperature control of the substrate 9, one substrate heating heater (temperature control unit) 201 may be mounted on the substrate 9 as shown in FIG. 7A, or plural substrate heating heaters (temperature control units) 201 may be mounted on the substrate 9 as shown in FIG. 7B. These substrate heating heaters 201 directly heat the substrate 9.

Figure 8:
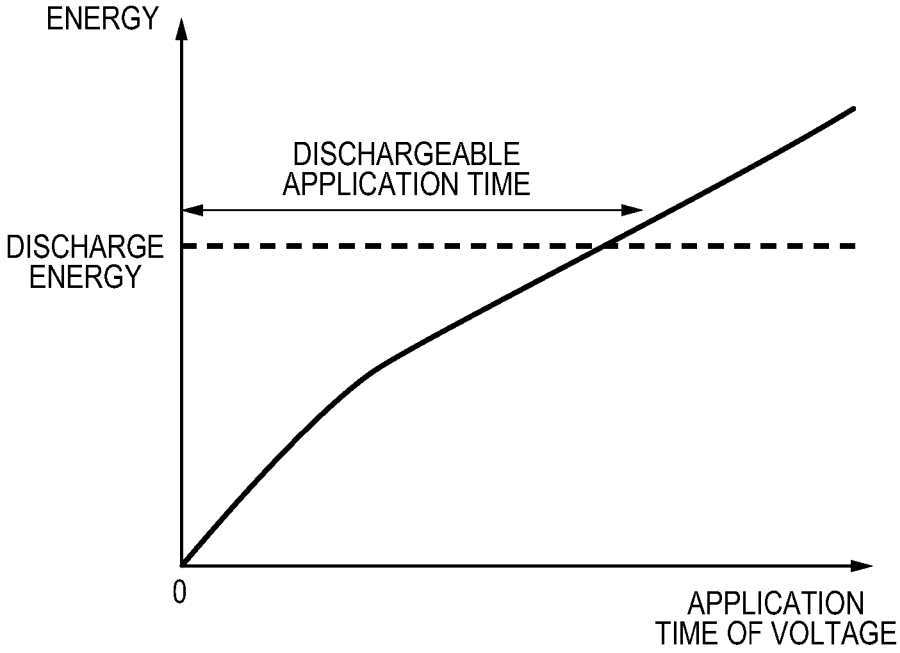
FIG. 8 is a graph illustrating an application time of an electric pulse for liquid discharging and an electric pulse for temperature control.

Further, the temperature control unit controlling the temperature of the substrate 9 may be the electric thermal conversion element as the heat generating element. In this case, as shown in FIG. 8, the temperature of the substrate 9 may be controlled by applying a voltage to the electric thermal conversion element by the time shorter than the liquid dischargeable application time. Likewise, it is desirable to provide a pulse control unit that applies electric energy smaller than electric energy having a magnitude of generating thermal energy for discharging the liquid to the electric thermal conversion element (first heat generating element) in advance before discharging the liquid from the nozzle. Further, the invention is not limited thereto, and the temperature control may be performed by various methods.

When the liquid and the first substrate portion 9*a* is warmed in advance by the temperature control unit, the viscosity of the liquid decreases, and the liquid may be discharged by small energy. Further, since the viscosity of the liquid decreases by an increase in temperature, there is an advantage that the speed of filling each nozzle with the liquid becomes faster.

In the embodiment, it is particularly effective when the printing operation is performed on a normal sheet with high duty by one scanning or the printing operation is performed with high speed, low pass, and elongated nozzle.

During this recording operation, since the temperature of the substrate 9 abruptly increases within one scan, even when a heat radiation mechanism such as a heat radiation plate radiating heat from the surface of the substrate 9 is provided in the liquid discharge head 30, the heat may exceed the heat radiation performance, so that the temperature of the substrate 9 increases. The temperature of the substrate 9 becomes higher as the discharge cycle of the liquid becomes shorter (the recording operation is performed at the high speed), and the temperature becomes higher as the density of the heat generating elements 24 becomes higher.

Figure 9A:
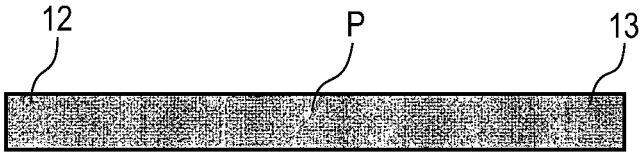
FIGS. 9A and 9B are schematic views illustrating an example of a recorded image having uniform concentration and an example when irregularity occurs in a recorded image obtained from recording data with uniform concentration.
Figure 9B:
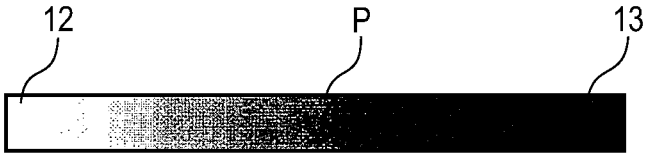

For example, as shown in FIG. 9A, when recording data is transmitted to the liquid discharge head 30 so that the recording operation is performed from one end portion 12 of the recording material (sheet) P to the other end portion 13 thereof by using all nozzles of the array, irregularity of the recording operation may occur as shown in FIG. 9B. This is because of the apparent phenomena in which the temperature distribution for each nozzle array is different, and it is more thickened at the end of the recording operation than the start of the recording operation in the nozzle array provided in the first substrate portion 9*a*.

When the liquid discharge amount of the nozzle array provided in the first substrate portion 9*a* is substantially equal to that of the nozzle array provided in the second substrate portion 9*b*, and the size Sa of the first heat generating element 24*a* is small, an increase in temperature for each nozzle array may become regular. In this manner, the recording operation may be clearly performed without irregularities by simply controlling the total nozzle arrays provided in the single substrate 9.

In the above-described embodiment, the substrate portion 9*a* having the small first heat generating element 24*a* is located at the edge portion 11 of the substrate, but the invention is not limited thereto. Specifically, when the first heat generating element 24*a* provided in the first substrate portion 9*a* is smaller than the second heat generating element 24*b* provided in the second substrate portion 9*b* having thermal capacity smaller than that of the first substrate portion 9*a*, it is apparent that the effect of the embodiment is obtained.

Other embodiments for realizing the reliable liquid discharge operation will be described below.

Figure 10:
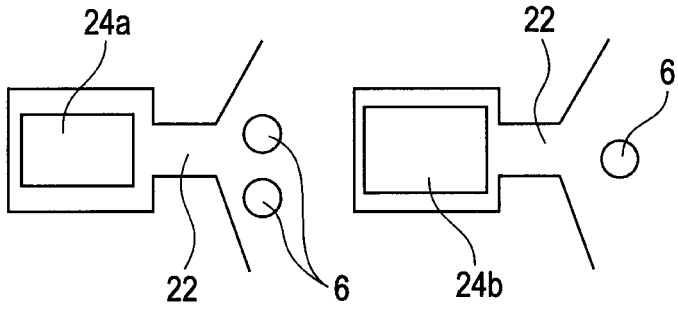
FIG. 10 is a schematic view illustrating the nozzle of the liquid discharge head of a second embodiment.

FIG. 10 is a schematic view illustrating the nozzle of the liquid discharge head of a second embodiment. In the embodiment, the number of the nozzle filters 6 with respect to the nozzle having the first heat generating element 24*a* provided in the first substrate portion having a small thermal capacity is more than the number of the nozzle filters with respect to the nozzle having the second heat generating element 24*b* provided in the second substrate portion having larger thermal capacity. In this manner, the total volume of the nozzle filter 6 increases, and the rear resistance Ra of the nozzle having the first heat generating element 24*a* increases. Accordingly, the same effect is obtained as in the case of FIG. 6.

Since the other configurations of the liquid discharge head are the same as those of the first embodiment, the description will not be repeated.

Figure 11:
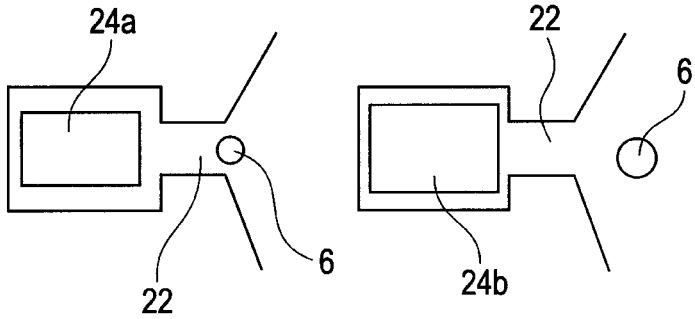
FIG. 11 is a schematic view illustrating the nozzle of the liquid discharge head of a third embodiment.

FIG. 11 is a schematic view illustrating the nozzle of the liquid discharge head of a third embodiment. In the embodiment, the nozzle filter 6 with respect to the nozzle having the first heat generating element 24*a* provided in the first substrate portion having a small thermal capacity is disposed closer to the vicinity of the passage 22 than the nozzle filter 6 with respect to the nozzle of the second substrate portion having a large thermal capacity. The rear resistance Ra of the nozzle having the first heat generating element 24*a* increases by setting the position of the nozzle filter 6 to be closer to the passage 22. Accordingly, since the passage 22 is substantially narrowed in the same manner as the second embodiment, the same effect is obtained as in the cases of FIGS. 6 and 10.

Since the other configurations of the liquid discharge head are the same as those of the first embodiment, the description will not be repeated.

Figure 12:
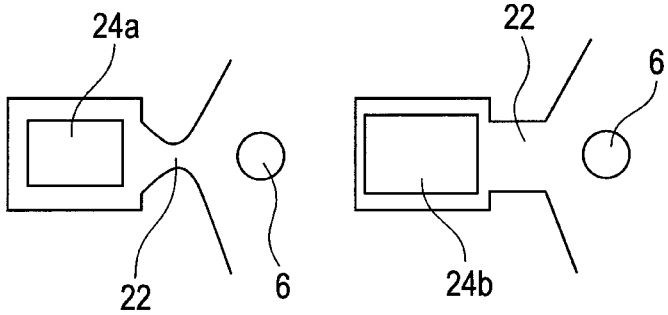
FIG. 12 is a schematic view illustrating the nozzle of the liquid discharge head of an example of a fourth embodiment.
Figure 13:
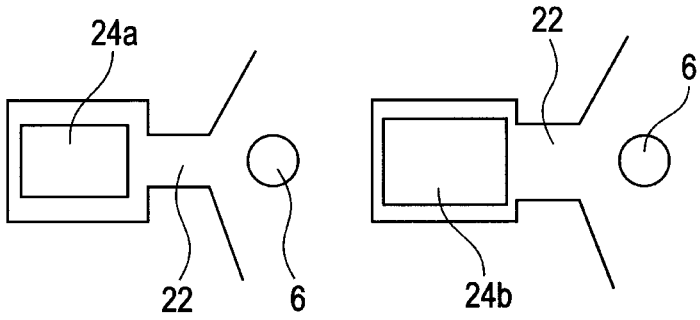
FIG. 13 is a schematic view illustrating the nozzle of the liquid discharge head of another example of the fourth embodiment.

FIGS. 12 and 13 are schematic views illustrating an example of the nozzle of the liquid discharge head of a fourth embodiment. In the embodiment, the width of the passage constituting the nozzle having the first heat generating element 24*a* provided in the first substrate portion having a small thermal capacity is smaller than that of the passage 22 constituting the nozzle having the second heat generating element 24*b* provided in the second substrate portion having a large thermal capacity. Accordingly, the rear resistance Ra of the nozzle having the first heat generating element 24*a* increases. Specifically, one narrow portion may be provided in the passage 22 (refer to FIG. 12), the entire passage 22 may be thinned (refer to FIG. 13), or the contact area may be increased. Accordingly, since the passage 22 is narrowed in the same manner as the second embodiment, the same effect is obtained as in the cases of FIGS. 6, 10, and 11.

Since the other configurations of the liquid discharge head are the same as those of the first embodiment, the description will not be repeated.

In the examples shown in FIGS. 10 to 13, the nozzle filter 6 has characteristics or the passage 22 is narrowed, whereby the bubble generated during the discharge operation is difficult to move to the common liquid chamber at the rear side (upstream), the growth of the bubble to the rear side is suppressed, and discharge energy is easily transferred to the side of the discharge port.

Figure 14:
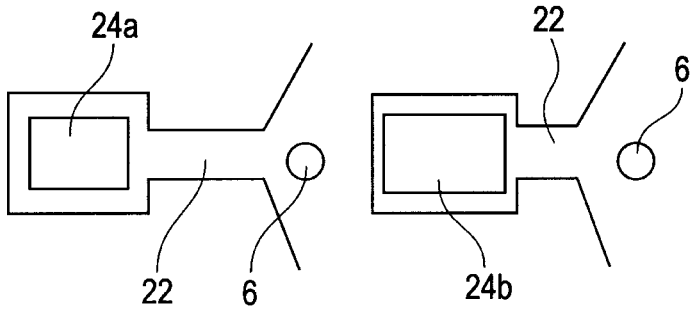
FIG. 14 is a schematic view illustrating the nozzle of the liquid discharge head of a fifth embodiment.

In a fifth embodiment, the nozzle having the first heat generating element 24*a* provided in the substrate portion having a small thermal capacity and the passage 22 communicating with the common liquid chamber are longer than the nozzle having the second heat generating element 24*b* provided in the substrate portion having a large thermal capacity and the passage 22 communicating with the common liquid chamber (refer to FIG. 14). Accordingly, as the distance until supplying the liquid to the bubbling chamber 23 becomes longer, the area of the liquid contacting the wall surface becomes larger, and the flow resistance of the liquid becomes larger, so that the rear resistance increases. Accordingly, the same effect is obtained as in the second to fourth embodiments.

Since the other configurations of the liquid discharge head are the same as those of the first embodiment, the description will not be repeated.

Figure 15:
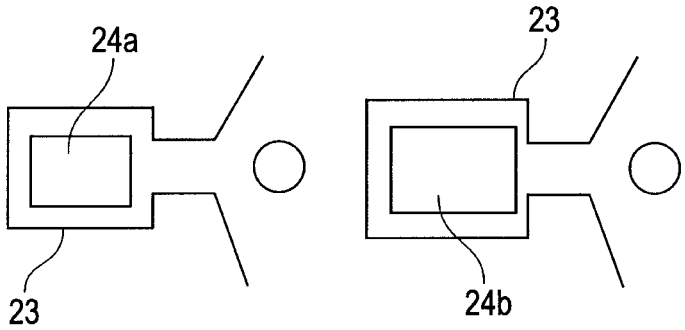
FIG. 15 is a schematic view illustrating the nozzle of the liquid discharge head of a sixth embodiment.

FIG. 15 is a schematic view illustrating the nozzle of the liquid discharge head of a sixth embodiment. In the embodiment, the bubbling chamber 23 having the first heat generating element 24*a* provided in the substrate portion having a small thermal capacity is smaller than the bubbling chamber having the second heat generating element 24*b* provided in the substrate portion having a large thermal capacity. As a result, the front resistance Rfa of the nozzle having the first heat generating element 24*a* decreases. Accordingly, the bubble generated during the discharge operation is easy to move to the front side (downstream), and discharge energy is easily transferred to the side of the discharge port. Therefore, the liquid is discharged from the nozzle with high efficiency.

Figure 16:
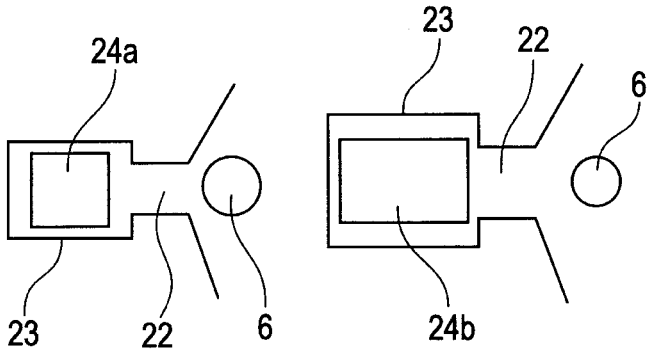
FIG. 16 is a schematic view illustrating an example of the nozzle of the liquid discharge head of variously combined embodiments.

FIGS. 6 and 10 to 15 shown in the above-described embodiments are merely examples. Thus, it is thought that these examples may be used in combination to form the nozzle shown in the example of FIG. 16 and may be variously modified. In FIG. 16, the nozzle filter 6 with respect to the nozzle having the first heat generating element 24*a* provided in the first substrate portion having a small thermal capacity is disposed closer to the vicinity of the passage 22 than the nozzle filter 6 with respect to the nozzle provided in the second substrate portion having a large thermal capacity. Further, the nozzle filter 6 with respect to the nozzle having the first heat generating element 24*a* is larger than the nozzle filter 6 with respect to the nozzle having the second heat generating element 24*b*. The passage 22 having the first heat generating element 24*a* is narrower than the passage 22 having the second heat generating element 24*b*. The bubbling chamber 23 having the first heat generating element 24*a* is smaller than the bubbling chamber 23 having the second heat generating element 24*b*.

As described above, when the rear resistance of the nozzle is set to be large, the filling of the liquid from the rear side (upstream) to the bubbling chamber 23 may be delayed. For this reason, it is desirable that a liquid having a high capillary force or low viscosity is supplied into the nozzle having the first heat generating element 24*a*. Further, instead of this configuration or together with this configuration, a liquid having a low boiling point may be disposed inside the nozzle having the first heat generating element 24*a* so that the bubbling timing becomes faster. When bubbling is conducted at a comparatively low temperature, the heating time may be entirely shortened even when the heating time necessary for the filling of the liquid to the nozzle is long.

Further, when the heating time (the voltage application time) until the generation of the bubble is short, the energy input time may be shortened. Accordingly, the time interval until the next discharge operation becomes wider, so that the substrate cooling time may be appropriately ensured.

The viscosity of the liquid supplied to the nozzle provided in the first substrate portion having a small thermal capacity may be lower than that of the liquid supplied to the nozzle provided in the second substrate portion having a large thermal capacity without changing the shape of the nozzle. Accordingly, the liquid discharge speed or the liquid discharge amount to the nozzle provided in the first substrate portion and the nozzle provided in the second substrate portion may be uniformly maintained. Further, when the recording operation starts while the liquid discharge head is maintained at a high temperature in advance, the liquid having low viscosity at the high temperature is disposed in the nozzle provided in the first substrate portion, thereby obtaining a uniform liquid discharge performance between the nozzle arrays.

The aspect ratio of the first heat generating element provided in the nozzle of the first substrate portion having a small thermal capacity may be smaller than that of the second heat generating element provided in the nozzle of the second substrate portion (refer to FIG. 16). When the aspect ratio of the heater is almost 1 and the heater has a rectangular shape, energy efficiency is high, and the heating time (voltage application time) is shortened. Accordingly, since the timer interval until the next liquid discharge operation becomes wider, an increase in the temperature of the first substrate portion is suppressed. Therefore, even when the first heat generating element 24*a* is small, the liquid may be discharged with the same voltage and voltage application time. Further, even when the applied voltage value increases, the bubbling of the liquid may be performed within the short application time.

Figure 17A:
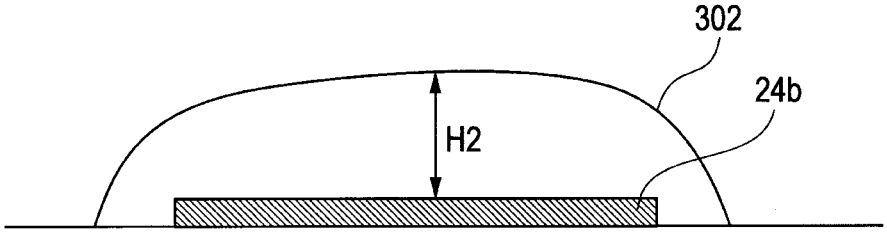
FIGS. 17A and 17B are schematic views illustrating a configuration around first and second heat generating elements of the liquid discharge head of a seventh embodiment.
Figure 17B:
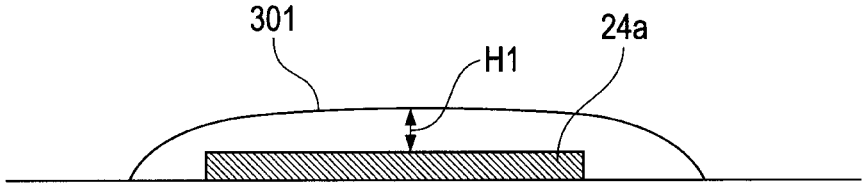

In the embodiment, a second protection film 302 (refer to FIG. 17A) is provided to cover the second heat generating element 24*b* provided in the second substrate portion having a large thermal capacity. Further, a first protection film 301 (refer to FIG. 17B) is provided to cover the first heat generating element 24*a* provided in the first substrate portion having a small thermal capacity.

The protection films 301 and 302 are provided to prevent the liquid filled into the nozzle after the liquid discharge operation from colliding with the heat generating elements 24*a* and 24*b*. Through the use of the protection films 301 and 302, it is possible to prevent an accident in which the liquid is thrown to the heat generating elements 24*a* and 24*b* to cut the surfaces of the heat generating elements 24*a* and 24*b* when the bubble inside the bubbling chamber disappear during the process in which the nozzle is filled with the liquid after the liquid is discharged. However, the protection films 301 and 302 suppress the energy transfer to the liquid. That is, as the thicknesses of the protection films 301 and 302 are larger, more energy is needed to discharge the liquid. In fact, it is proved that the time of applying energy to the heat generating elements 24*a* and 24*b* to discharge the liquid becomes longer when the thicknesses of the protection films 301 and 302 become larger. Therefore, in the embodiment, the film thickness H1 of the first protection film 301 is set to be smaller than the film thickness H2 of the second protection film 302. Accordingly, the thermal responsiveness to the liquid inside the bubbling chamber from the first heat generating element 24*a* is improved. In this manner, since the liquid inside the nozzle having the first heat generating element may be discharged within the shorter time, there is an advantage that the heat quantity given to the liquid becomes smaller.

Figure 18A:
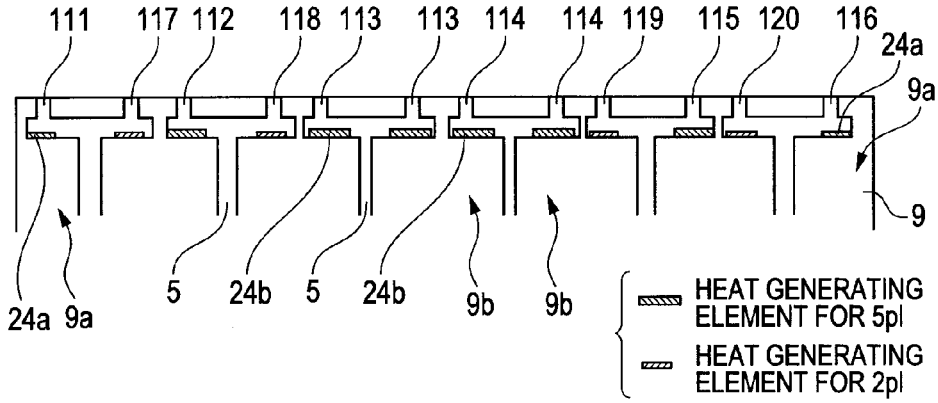
FIG. 18A is a schematic cross-sectional view illustrating the substrate of the liquid discharge head of a tenth embodiment.

FIG. 18A is a schematic cross-sectional view illustrating the discharge port formation surface of the substrate provided in the liquid discharge head of an example of the embodiment. In FIG. 18A, the arrangement of the nozzles is the same as that of FIG. 2A. FIG. 18A is a cross-sectional view of the substrate taken along the line in the direction A of FIG. 2A.

In the example, the liquid discharge amount from the discharge ports 111 to 116 is 5 pl, and the liquid discharge amount from the discharge ports 117 to 120 is 2 pl. Further, the common liquid chamber 5 is located at a position interposed between two discharge ports (discharge port arrays).

Figure 18B:
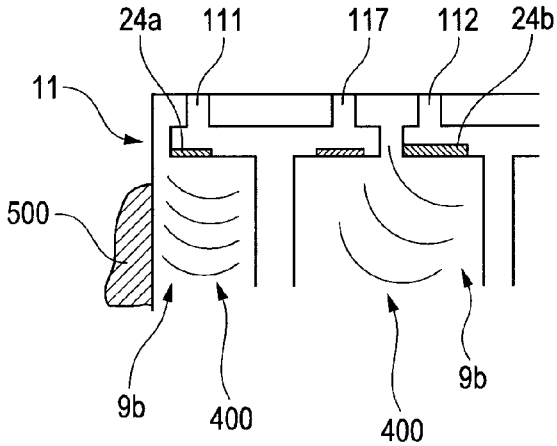
FIG. 18B is an enlarged view illustrating the vicinity of the edge portion of the substrate.

FIG. 18B is an enlarged view of the vicinity of the edge portion 11 of the substrate shown in FIG. 18A. The thermal conduction is depicted by the curve 400. Even when 5 pl of a large liquid droplet is discharged from the discharge port 111, the volume of the thermal diffusion area (first substrate portion 9*a*) is small. For this reason, the first heat generating element 24*a* of the first substrate portion 9*a* provided with the discharge port arrays 111 and 116 is set to be smaller than the second heat generating element 24*b* of the second substrate portion 9*b* provided with the discharge port arrays 112 to 115. In the embodiment, an irregular increase in temperature in the vicinity of the discharge port for the large liquid droplet of 5 pl may be particularly considered as a problem. This is because a difference in temperature occurs between the heat generating element for the large liquid droplet of 5 pl located at the inner side of the substrate and the heat generating element for the large liquid droplet of 5 pl located at the edge portion 11 of the substrate. Even when the nozzle for the small liquid droplet (2 pl) is in the recording mode in which the recording operation is performed at high speed with high duty and low pass, since the heat generating element 24*b* for small liquid droplet is present in the substrate portion 9*b* having the same volume, irregularity in temperature does not occur. When the heat generating elements 24*b* for 5 pl provided in the inner substrate portion 9*b* have the same size, there is substantially no difference in temperature. In this case, the heat generating elements 24*b* do not need to have different sizes. Further, in the embodiment, even when the recording operation is performed by using the large liquid droplet and the small liquid droplet, the size of the first heat generating element 24*a* of the substrate portion 9*a* having a small thermal capacity is smaller than the size of the second heat generating element 24*b* of the substrate portion 9*b* having a large thermal capacity.

Figure 19:
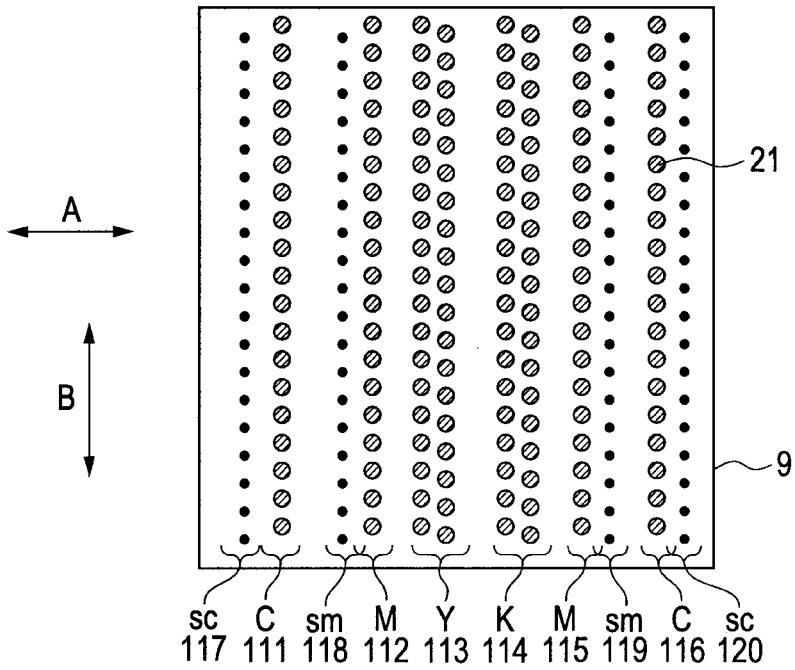
FIG. 19 is a schematic view illustrating a substrate of a liquid discharge head of an eleventh embodiment.

In FIG. 19, the nozzle arrays (discharge port arrays 117 and 120) discharging the small liquid droplet are located at the end portion of the substrate differently from the arrangement of FIG. 2A. Even in this case, there is a difference in the thermal capacity and/or the heat transfer coefficient of the substrate portion divided by the liquid as in the common liquid chamber and the edge portion of the substrate that are insulated by air or a sealing material (refer to the reference numeral 500 in FIG. 18B). For this reason, the size of the first heat generating element provided in the first substrate portion located at the edge portion of the substrate is set to be smaller than the size of the second heat generating element located at the inner side of the substrate.

Figure 20A:
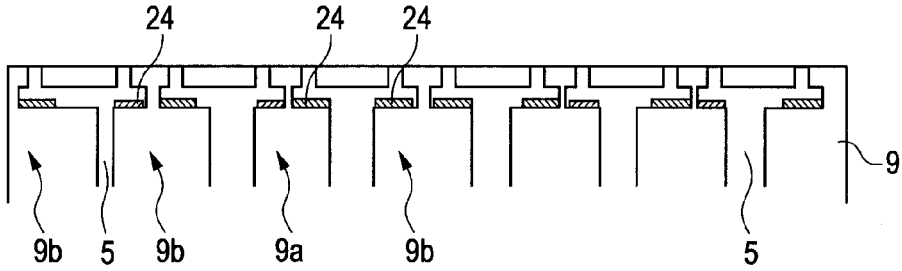
FIGS. 20A, 20B, 20C and 20D are schematic views illustrating the substrate of the liquid discharge head of a twelfth embodiment.

FIG. 20A illustrates an example when thermal capacity of the substrate portion located at the inner side of the substrate is smaller than that of the substrate portion located at the edge portion of the substrate. In FIG. 20A, the volume of the first substrate portion 9*a* having a small thermal capacity is set to be smaller than that of the other substrate portion 9*b*. In this case, except for the arrangement at the edge portion of the substrate, three types of pattern may be conceived as below since two arrays of heat generating elements 24 are present in the substrate portions 9*a* and 9*b*.

Figure 20B:
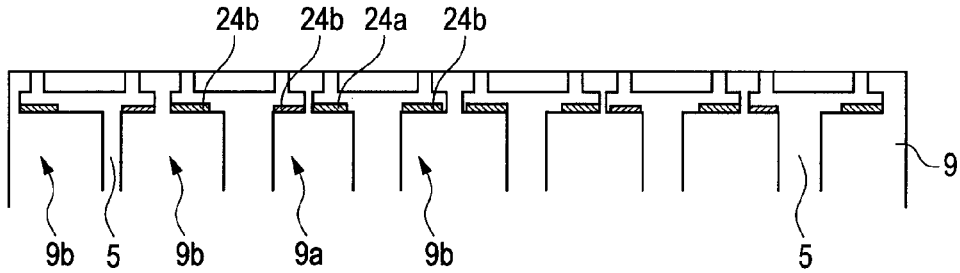

(1) An example suitable for the case where the heat generating element for 5 pl is frequently used for high speed driving and high duty, but the heat generating element for 2 pl is not frequently used for high speed driving and high duty As shown in FIG. 20B, it is desirable that only the heat generating element 24*a* for 5 pl provided in the first substrate portion 9*a* having a small thermal capacity is made small.

Figure 20C:
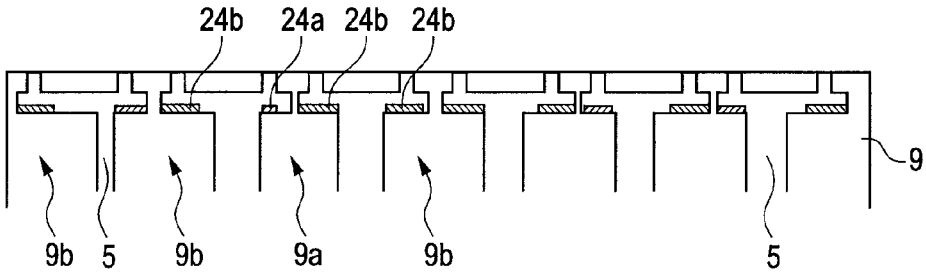

(2) An example suitable for the case where the heat generating element for 2 pl is frequently used for high speed driving and high duty, but the heat generating element for 5 pl is not frequently used for high speed driving and high duty As shown in FIG. 20C, it is desirable that only the heat generating element 24*a* for 2 pl provided in the first substrate portion 9*a* having a small thermal capacity is made small.

Figure 20D:
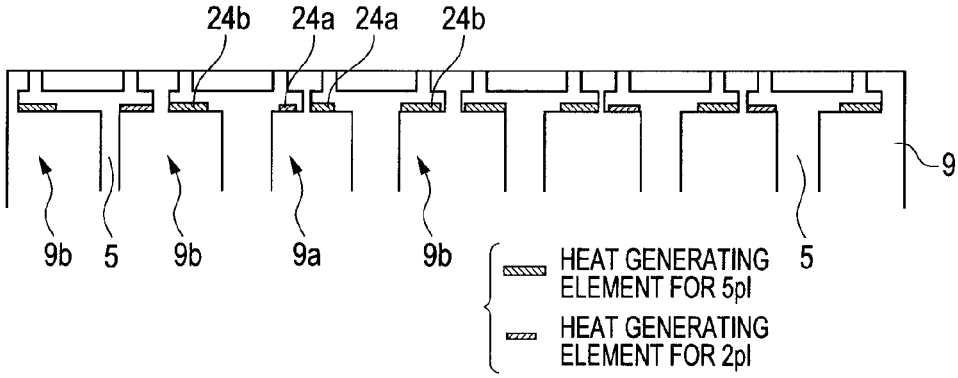

(3) An example suitable for the case where both of the heat generating elements for 5 pl and 2 pl are frequently used for high speed and high duty As show in FIG. 20D, it is desirable that each size of the heat generating elements 24*a* for 5 pl and 2 pl provided in the first substrate portion 9*a* having a small thermal capacity is set to be smaller than the size of the heat generating element 24*b* provided in the other substrate portion 9*b*.

In the embodiment, two types of liquid droplets of 5 pl and 2 pl are mentioned, but the invention is not limited thereto. That is, the invention may be applied to the case where the liquid droplets have three or more sizes.

Figure 21:
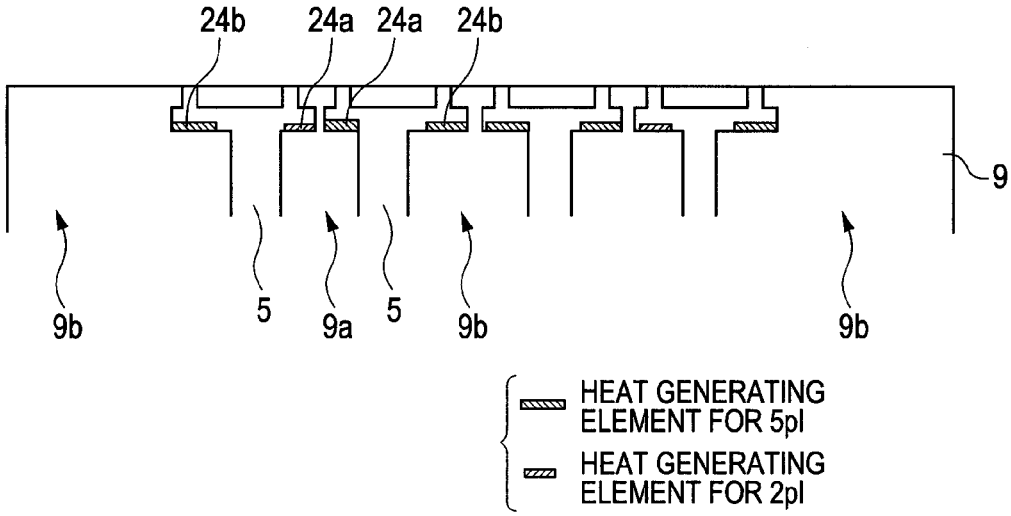
FIG. 21 is a schematic cross-sectional view illustrating the substrate of the liquid discharge head of a thirteenth embodiment.

As shown in FIG. 21, when the substrate portion 9*b* located at the edge portion 11 of the substrate is sufficiently large and the thermal conductivity or thermal capacity of the substrate portion 9*b* is sufficiently large, the heat generating element 24*a* located at the substrate portion 9*a* having a small thermal conductivity or thermal capacity is set to be smaller than the heat generating element 24*b* located in the other substrate portion 9*b*. Accordingly, an increase in temperature may be uniform. Even in this case, since two arrays of the heat generating elements 24*a* are present in the substrate portion 9*a* having a small thermal conductivity or thermal capacity, three types of patterns may be supposed in accordance with the use frequency or the use purpose as in the twelfth embodiment.

Figure 22A:
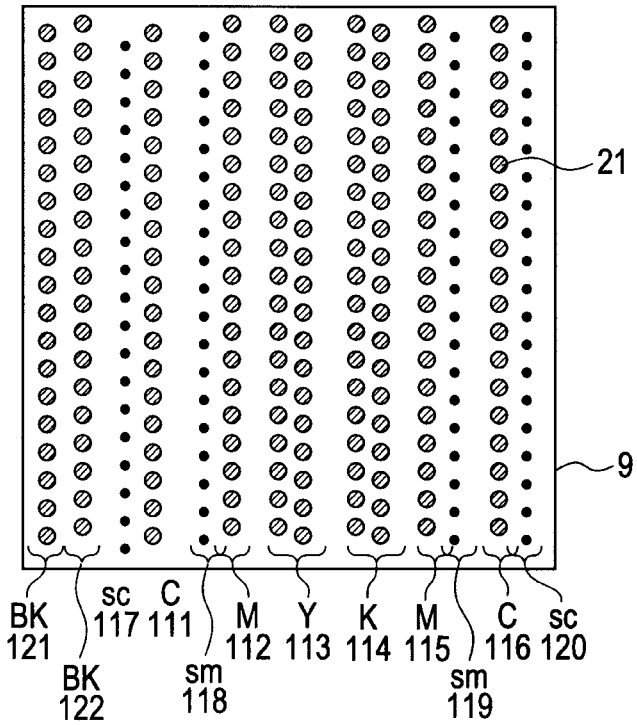
FIGS. 22A, 22B, 22C and 22D are schematic views illustrating the liquid discharge head of an example of a fourteenth embodiment.
Figure 22B:
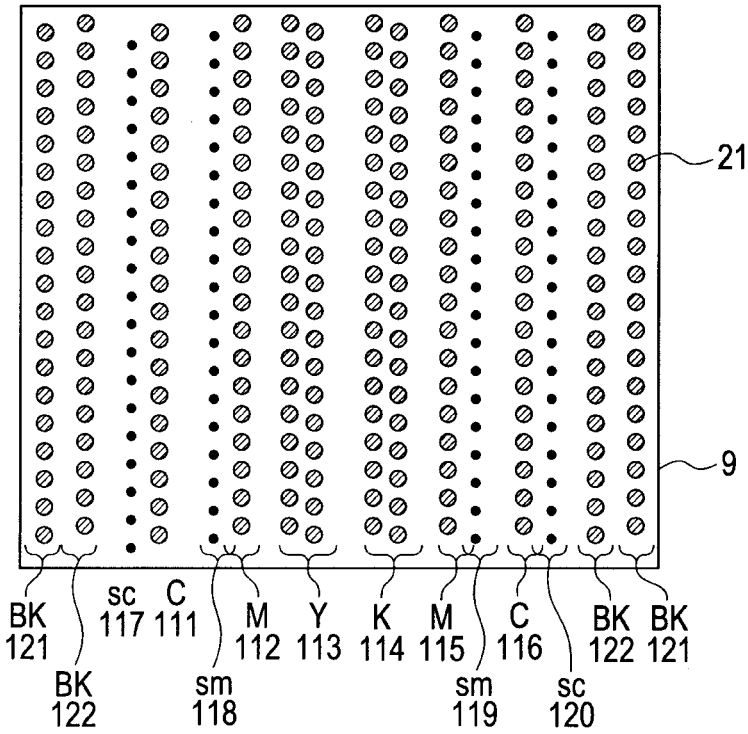
Figure 22C:
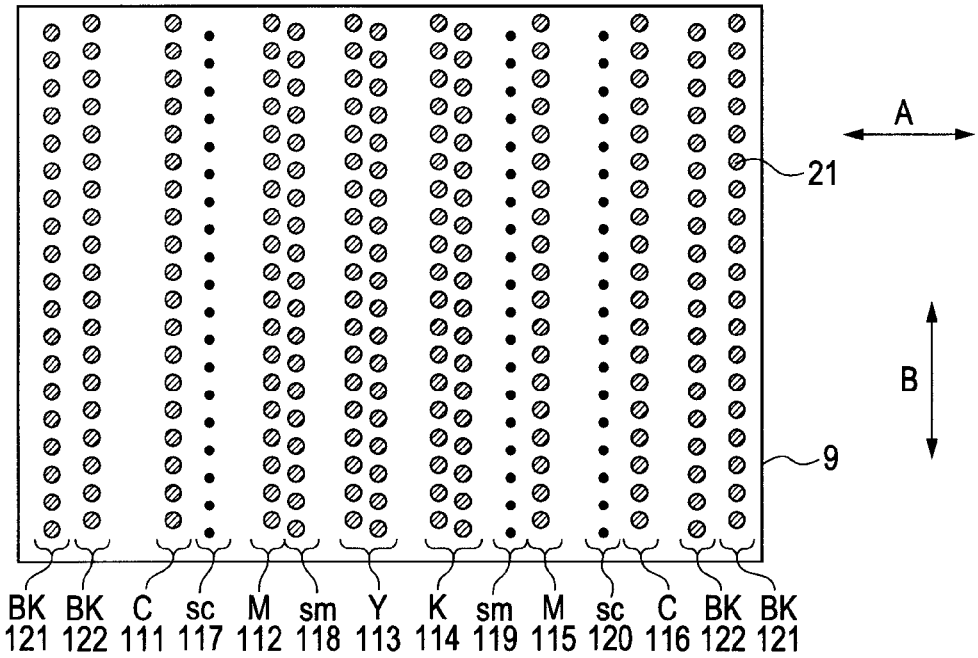
Figure 22D:
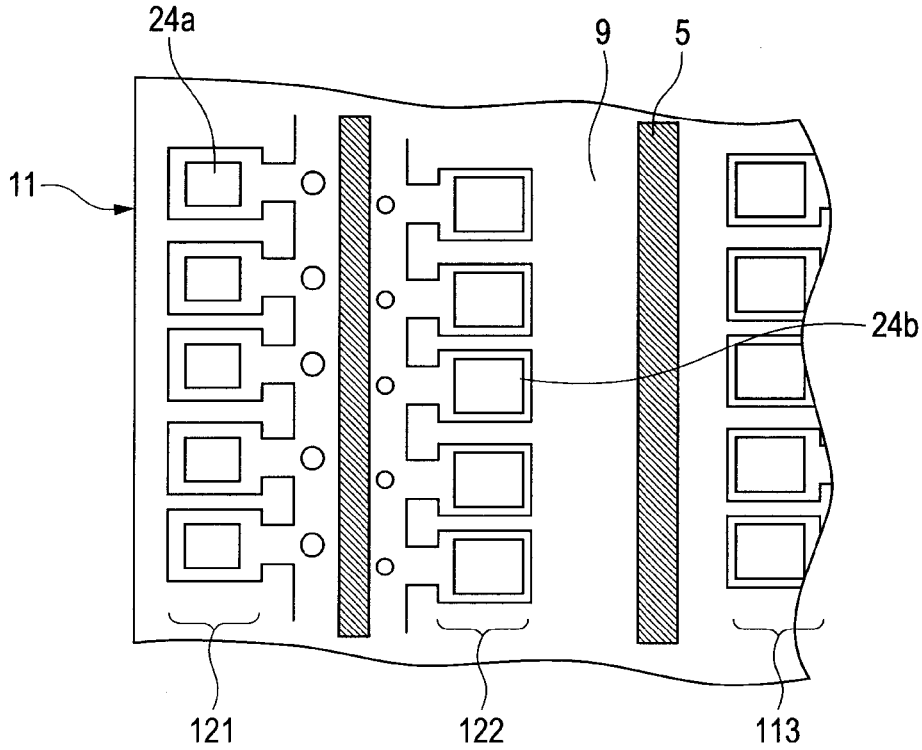

FIGS. 22A to 22C are schematic plan views illustrating the discharge port formation surface of the liquid discharge head according to the examples of the embodiment. As shown in FIGS. 22A to 22C, in the embodiment, the discharge port arrays 121 and 122 mainly used to discharge black ink forming character texts are interposed between the common liquid chambers. In this case, as shown in FIG. 22D, the discharge port array 121 located at the end portion of the substrate has the heat generating element 24*a* smaller than the second heat generating element 24*b* of the adjacent nozzle array discharging the same color of ink by the same discharge amount.

Figure 23:
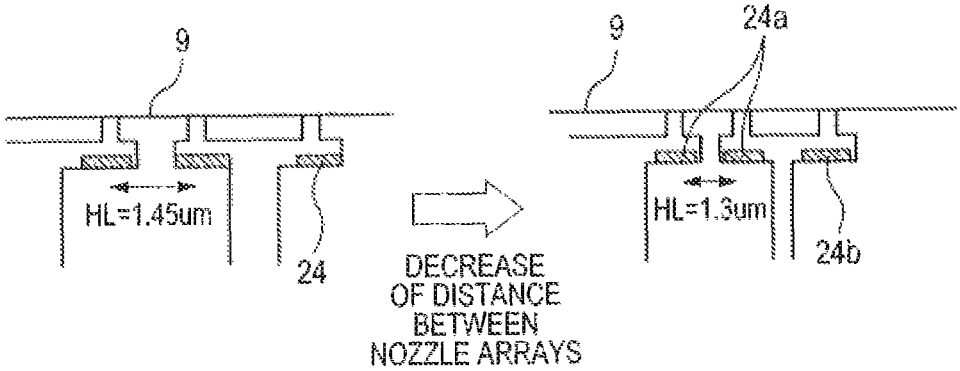
FIG. 23 is a schematic cross-sectional view illustrating the substrate of the liquid discharge head of a fifteenth embodiment.
Figure 24:
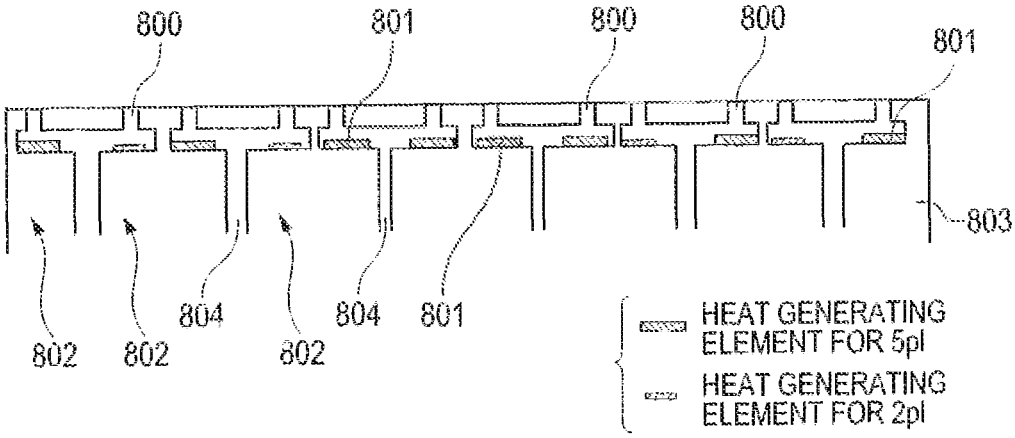
FIG. 24 PRIOR ART
FIG. 24 is a schematic view illustrating a problem of the liquid discharge head of the related art.

As shown in FIG. 23, when the substrate 9 shrinks or is designed to have a short distance between the nozzle arrays, the distance (center-to-center distance) HL between the adjacent heat generating elements 24 becomes short even at the same discharge amount. In this case, the size of the heat generating element 24*a* at the short distance is set to be smaller than that of the other heat generating element 24*b* so that an increase in temperature is suppressed and irregularity in the recording operation is reduced. This configuration may be appropriately used even when the liquid discharge head 30 is newly designed to shrink more than that of preceding designs due to more advanced technology.

In the above-described embodiments, the cases have been exemplified in which the liquid discharge amounts are 2 pl and 5 pl, but the invention is not limited thereto. That is, the liquid discharge amount may be arbitrarily set.

While the exemplary embodiments of the invention have been described in detail, the invention is not limited thereto, and it should be understood that the invention may be modified and corrected in various forms as long as it does not depart from the concept of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-068191, filed Mar. 24, 2010, which is hereby incorporated by reference herein in its entirety.

What is claimed is:

1. A liquid discharge head comprising:

a substrate including a plurality of nozzle arrays, each of which is formed by arranging nozzles having heat generating elements generating thermal energy for discharging a liquid, and a plurality of common liquid chambers formed along the plurality of nozzle arrays to supply the liquid to the plurality of nozzle arrays, the substrate being divided into a plurality of substrate portions by the plurality of common liquid chambers, wherein the substrate includes a first substrate portion having a first nozzle array among the plurality of nozzle arrays and a second substrate portion having a second nozzle array different from the first nozzle array and a thermal capacity larger than that of the first substrate portion, wherein a heating area of a first heat generating element provided in the first nozzle array is smaller than that of a second heat generating element provided in the second nozzle array, and wherein an amount of the liquid discharged from a nozzle of the second nozzle array is at least 0.7 times and no more than 1.3 times an amount of the liquid discharged from a nozzle of the first nozzle array.

2. The liquid discharge head according to claim 1, wherein the first substrate portion is located at an end portion of the substrate interposed between an edge portion of the substrate and one of the common liquid chambers, and wherein the second substrate portion is interposed between adjacent common liquid chambers.

3. The liquid discharge head according to claim 1, wherein each nozzle of the nozzle arrays includes a bubbling chamber which holds the liquid, a discharge port which discharges the liquid inside the bubbling chamber, a passage which allows one of the common liquid chambers and the bubbling chamber to communicate with each other, and one of the heat generating elements.

4. The liquid discharge head according to claim 3, wherein when a first rear resistance defined by the sum of flow resistance and viscous resistance from the common liquid chamber to a boundary between the passage and the bubbling chamber of a nozzle of the first nozzle array is denoted by Ra, and a second rear resistance defined by the sum of flow resistance and viscous resistance from the common liquid chamber to a boundary between the passage and the bubbling chamber of a nozzle of the second nozzle array is denoted by Rb, the relationship of $Ra>Rb$ is satisfied.

5. The liquid discharge head according to claim 3, wherein when a first rear resistance defined by the sum of flow resistance and viscous resistance from the common liquid chamber to a boundary between the passage and the bubbling chamber of a nozzle of the first nozzle array is denoted by Ra, a first front resistance defined by the sum of flow resistance and viscous resistance from the bubbling chamber to an opening side end portion of the discharge port of the nozzle of the first nozzle array is denoted by Rfa, a second rear resistance defined by the sum of flow resistance and viscous resistance from the common liquid chamber to a boundary between the passage and the bubbling chamber of a nozzle of the second nozzle array is denoted by Rb, and a second front resistance defined by the sum of flow resistance and viscous resistance from the bubbling chamber to an opening side end portion of the discharge port of the nozzle of the second nozzle array is denoted by Rfb, the relationship of $Rfa/Ra<Rfb/Rb$ is satisfied.

6. The liquid discharge head according to claim 3, wherein each nozzle of the first nozzle array communicates with a first common liquid chamber among the plurality of common liquid chambers, wherein each nozzle of the second nozzle array communicates with a second common liquid chamber different from the first common liquid chamber, and wherein a first liquid supplied into the first common liquid chamber is discharged by thermal energy lower than that for a second liquid supplied into the second common liquid chamber.

7. The liquid discharge head according to claim 6, wherein viscosity of the first liquid is lower than that of the second liquid.

8. The liquid discharge head according to claim 6, wherein a boiling point of the first liquid is lower than that of the second liquid.

9. The liquid discharge head according to claim 6, wherein a capillary force of the first liquid with respect to the nozzle of the first nozzle array is larger than that of the second liquid with respect to the nozzle of the second nozzle array.

10. The liquid discharge head according to claim 1, further comprising:

a first protection film which covers the surface of the first heat generating element; and a second protection film which covers the surface of the second heat generating element, wherein a film thickness of the first protection film is smaller than that of the second protection film.

11. The liquid discharge head according to claim 1, further comprising:

a temperature control unit which maintains a temperature of the first substrate portion provided with the first nozzle array at the timing before discharging the liquid from the nozzles to be higher than a temperature of the second substrate portion provided with the second nozzle array at the timing before discharging the liquid from the nozzles.

12. The liquid discharge head according to claim 11, wherein the first heat generating element is an electric thermal conversion element which converts electric energy into thermal energy, wherein the temperature control unit includes the first heat generating element, and wherein the liquid discharge head further comprises a pulse control unit which applies electric energy smaller than electric energy having a magnitude of generating thermal energy for discharging the liquid to the first heat generating element before discharging the liquid from the nozzle.

13. The liquid discharge head according to claim 11, wherein the temperature control unit includes a substrate heating heater which is provided in the substrate to directly heat the substrate.

* * * * *